US009165506B2

(12) United States Patent
Gu et al.

(10) Patent No.: US 9,165,506 B2
(45) Date of Patent: Oct. 20, 2015

(54) ORGANIC LIGHT EMITTING DISPLAY DEVICE AND METHOD OF DRIVING AN ORGANIC LIGHT EMITTING DISPLAY DEVICE

(71) Applicant: Samsung Display Co., Ltd., Yongin, Gyeonggi-Do (KR)

(72) Inventors: Bon-Seog Gu, Yongin (KR); Hae-Kwan Seo, Yongin (KR); Jin-Wook Yang, Yongin (KR)

(73) Assignee: Samsung Display Co., Ltd., Giheung-Gu, Yongin-si, Gyeonggi-Do (KR)

( * ) Notice: Subject to any disclaimer, the term of this patent is extended or adjusted under 35 U.S.C. 154(b) by 85 days.

(21) Appl. No.: 13/930,722

(22) Filed: Jun. 28, 2013

(65) Prior Publication Data

US 2014/0176616 A1 Jun. 26, 2014

(30) Foreign Application Priority Data

Dec. 26, 2012 (KR) ..... 10-2012-0153096

(51) Int. Cl.
*G09G 3/32* (2006.01)
*G09G 3/20* (2006.01)

(52) U.S. Cl.
CPC ..... *G09G 3/3266* (2013.01); *G09G 3/2092* (2013.01); *G09G 3/3208* (2013.01); *G09G 2300/0861* (2013.01); *G09G 2310/0218* (2013.01); *G09G 2310/0283* (2013.01)

(58) Field of Classification Search
CPC ..... G09G 2310/0224; G09G 2310/0283
USPC ..... 345/100; 377/64–81; 340/12.21
See application file for complete search history.

(56) References Cited

U.S. PATENT DOCUMENTS

| | | | | |
|---|---|---|---|---|
| 2006/0244705 | A1* | 11/2006 | Song et al. | 345/98 |
| 2007/0171175 | A1* | 7/2007 | Chiang et al. | 345/100 |
| 2009/0027369 | A1 | 1/2009 | Lee et al. | |
| 2009/0295782 | A1 | 12/2009 | Lee et al. | |
| 2010/0091006 | A1 | 4/2010 | Yoo et al. | |
| 2010/0220093 | A1* | 9/2010 | Choi | 345/213 |
| 2011/0164017 | A1 | 7/2011 | Chung | |
| 2011/0187691 | A1 | 8/2011 | Chung | |
| 2012/0038608 | A1 | 2/2012 | Seo et al. | |
| 2012/0062524 | A1 | 3/2012 | Kim | |

FOREIGN PATENT DOCUMENTS

| | | |
|---|---|---|
| KR | 10-1084182 | 11/2011 |
| KR | 10-1108165 | 1/2012 |
| KR | 10-2012-0028011 | 3/2012 |

* cited by examiner

*Primary Examiner* — Michael Pervan
(74) *Attorney, Agent, or Firm* — Robert E. Bushnell, Esq.

(57) ABSTRACT

In a method of driving an organic light emitting display device, a first data signal constituting an image frame is sequentially written into first pixel circuits coupled to first scan-lines by sequentially performing a scanning operation on the first scan-lines in a first direction, a second data signal constituting the image frame is sequentially written into second pixel circuits coupled to second scan-lines by sequentially performing the scanning operation on the second scan-lines in a second direction, and the image frame is displayed by controlling the first and second pixel circuits to simultaneously emit light.

13 Claims, 10 Drawing Sheets

ORGANIC LIGHT EMITTING DISPLAY DEVICE AND METHOD OF DRIVING AN ORGANIC LIGHT EMITTING DISPLAY DEVICE

CLAIM OF PRIORITY

This application makes reference to, incorporates into this specification the entire contents of, and claims all benefits accruing under 35 U.S.C. §119 from an application earlier filed in the Korean Intellectual Property Office on Dec. 26, 2012 and there duly assigned Serial No. 10-2012-0153096.

BACKGROUND OF THE INVENTION

1. Field of the Invention

The present invention relates generally to a flat panel display device. More particularly, the present invention relates to an organic light emitting display device employing a simultaneous emission driving technique, and a method of driving the organic light emitting display device.

2. Description of the Related Art

Recently, an organic light emitting display device is widely used as a flat panel display device included in an electronic device. A technique for driving the organic light emitting display device may be classified roughly into a sequential emission driving technique and a simultaneous emission driving technique. Specifically, the sequential emission driving technique sequentially performs a scanning operation by each scan-line, and then sequentially controls pixel circuits to emit light by each scan-line (i.e., sequentially performs a light emitting operation). On the other hand, the simultaneous emission driving technique sequentially performs the scanning operation by each scan-line, and then controls all pixel circuits to simultaneously emit light (i.e., simultaneously performs a light emitting operation).

Generally, in the simultaneous emission driving technique, a frame operation period for displaying one image frame may include an initialization period for performing an initializing operation, a reset period for performing a resetting operation, a threshold voltage compensation period for performing a threshold voltage compensating operation, a scan period for performing a scanning operation, and an emission period for performing a light emitting operation. Here, each of the initializing operation, the resetting operation, the threshold voltage compensating operation, and the light emitting operation is simultaneously performed for all pixel circuits, whereas the scanning operation is sequentially performed for all pixel circuits by each scan-line.

As described above, when the simultaneous emission driving technique implements (i.e., displays) one image frame, the scanning operation is sequentially performed for all pixel circuits by each scan-line. Thus, a delay (e.g., about 3 ms~4 ms) may occur between the time when a data signal is applied to pixel circuits coupled to upper scan-lines (or lower scan-lines) and the time when a data signal is applied to pixel circuits coupled to the lower scan-lines (or the upper scan-lines) because the scanning operation is sequentially performed from a top scan-line to a bottom scan-line, or from the bottom scan-line to the top scan-line.

However, the light emitting operation is simultaneously performed for all pixel circuits to implements one image frame. Thus, an emission waiting time (i.e., a waiting time for the light emitting operation) of the pixel circuits coupled to the upper scan-lines (or the lower scan-lines) may be longer than an emission waiting time of the pixel circuits coupled to the lower scan-lines (or the upper scan-lines) if the scanning operation is sequentially performed from the top scan-line (or the bottom scan-line) to the bottom scan-line (or the top scan-line). Thus, a difference between these emission waiting times may result in a voltage drop due to a leakage current, etc (i.e., a change of a data voltage stored in a storage capacitor of respective pixel circuits). As a result, the luminance uniformity of a display panel included in the organic light emitting display device may be greatly degraded.

SUMMARY OF THE INVENTION

The present invention provides a method of driving an organic light emitting display device capable of improving a luminance uniformity of a display panel by controlling an average emission waiting time of pixel circuits coupled to odd scan-lines and an average emission waiting time of pixel circuits coupled to even scan-lines so as to be close to an average emission waiting time of pixel circuits coupled to all scan-lines.

Some exemplary embodiments provide an organic light emitting display device capable of displaying (i.e., outputting) a high-quality image.

According to the present invention, a method of driving an organic light emitting display device may include a step of sequentially writing a first data signal constituting an image frame into first pixel circuits coupled to first scan-lines by sequentially performing a scanning operation on the first scan-lines in a first direction, a step of sequentially writing a second data signal constituting the image frame into second pixel circuits coupled to second scan-lines by sequentially performing the scanning operation on the second scan-lines in a second direction, and a step of displaying the image frame by controlling the first and second pixel circuits to simultaneously emit light.

In exemplary embodiments, the first scan-lines may correspond to odd scan-lines, and the second scan-lines may correspond to even scan-lines.

In exemplary embodiments, the first scan-lines may correspond to even scan-lines, and the second scan-lines may correspond to odd scan-lines.

In exemplary embodiments, the first direction may correspond to a direction from a top scan-line to a bottom scan-line, and the second direction may correspond to a direction from the bottom scan-line to the top scan-line.

In exemplary embodiments, the first direction may correspond to a direction from a bottom scan-line to a top scan-line, and the second direction may correspond to a direction from the top scan-line to the bottom scan-line.

According to the present invention, a method of driving an organic light emitting display device may include a step of sequentially writing a first data signal constituting a (2k−1)th image frame, where k is an integer greater than or equal to 1, into first pixel circuits coupled to first scan-lines by sequentially performing a scanning operation on the first scan-lines in a first direction, a step of sequentially writing a second data signal constituting the (2k−1)th image frame into second pixel circuits coupled to second scan-lines by sequentially performing the scanning operation on the second scan-lines in a second direction, a step of displaying the (2k−1)th image frame by controlling the first and second pixel circuits to simultaneously emit light, a step of sequentially writing a third data signal constituting a (2k)th image frame into the first pixel circuits coupled to the first scan-lines by sequentially performing the scanning operation on the first scan-lines in the second direction, a step of sequentially writing a fourth data signal constituting the (2k)th image frame into the second pixel circuits coupled to the second scan-lines by sequentially performing the scanning operation on the second scan-lines in the first direction, and a step of displaying the (2k)th image frame by controlling the first and second pixel circuits to simultaneously emit light.

In exemplary embodiments, the first scan-lines may correspond to odd scan-lines, and the second scan-lines may correspond to even scan-lines.

In exemplary embodiments, the first scan-lines may correspond to even scan-lines, and the second scan-lines may correspond to odd scan-lines.

In exemplary embodiments, the first direction may correspond to a direction from a top scan-line to a bottom scan-line, and the second direction may correspond to a direction from the bottom scan-line to the top scan-line.

In exemplary embodiments, the first direction may correspond to a direction from a bottom scan-line to a top scan-line, and the second direction may correspond to a direction from the top scan-line to the bottom scan-line.

According to the present invention, a method of driving an organic light emitting display device may include a step of sequentially writing a first data signal constituting a (2k−1)th image frame, where k is an integer greater than or equal to 1, into pixel circuits coupled to all scan-lines by sequentially performing a scanning operation on the scan-lines in a first direction, a step of displaying the (2k−1)th image frame by controlling the pixel circuits to simultaneously emit light, a step of sequentially writing a second data signal constituting a (2k)th image frame into the pixel circuits coupled to the scan-lines by sequentially performing the scanning operation on the scan-lines in a second direction, and a step of displaying the (2k)th image frame by controlling the pixel circuits to simultaneously emit light.

In exemplary embodiments, the first direction may correspond to a direction from a top scan-line to a bottom scan-line, and the second direction may correspond to a direction from the bottom scan-line to the top scan-line.

In exemplary embodiments, the first direction may correspond to a direction from a bottom scan-line to a top scan-line, and the second direction may correspond to a direction from the top scan-line to the bottom scan-line.

According to the present invention, an organic light emitting display device may include a display panel having a plurality of pixel circuits, a scan driving unit that provides a scan signal to the pixel circuits, a data driving unit that provides a data signal to the pixel circuits, a power unit that provides a high power voltage and a low power voltage to the pixel circuits, a control signal generating unit that provides an emission control signal to the pixel circuits, the emission control signal being for controlling the pixel circuits to simultaneously emit light, and a timing control unit that controls the scan driving unit, the data driving unit, the power unit, and the control signal generating unit. In the latter regard, the scan driving unit may control an average emission waiting time of the pixel circuits coupled to odd scan-lines and an average emission waiting time of the pixel circuits coupled to even scan-lines so as to be close to an average emission waiting time of the pixel circuits coupled to all scan-lines.

In exemplary embodiments, the organic light emitting display device may operate based on a simultaneous emission driving technique.

In exemplary embodiments, the scan driving unit may sequentially write a first data signal constituting an image frame into first pixel circuits coupled to the odd scan-lines by sequentially performing a scanning operation on the odd scan-lines in a first direction, and may sequentially write a second data signal constituting the image frame into second pixel circuits coupled to the even scan-lines by sequentially performing the scanning operation on the even scan-lines in a second direction.

In exemplary embodiments, the first direction may correspond to a direction from a top scan-line to a bottom scan-line, and the second direction may correspond to a direction from the bottom scan-line to the top scan-line.

In exemplary embodiments, the first direction may correspond to a direction from a bottom scan-line to a top scan-line, and the second direction may correspond to a direction from the top scan-line to the bottom scan-line.

In exemplary embodiments, the scan driving unit may sequentially write a first data signal constituting a (2k−1)th image frame, where k is an integer greater than or equal to 1, into first pixel circuits coupled to the odd scan-lines by sequentially performing a scanning operation on the odd scan-lines in a first direction, and may sequentially write a second data signal constituting the (2k−1)th image frame into second pixel circuits coupled to the even scan-lines by sequentially performing the scanning operation on the even scan-lines in a second direction.

In exemplary embodiments, the scan driving unit may sequentially write a third data signal constituting a (2k)th image frame into the first pixel circuits coupled to the odd scan-lines by sequentially performing the scanning operation on the odd scan-lines in the second direction, and may sequentially write a fourth data signal constituting the (2k)th image frame into the second pixel circuits coupled to the even scan-lines by sequentially performing the scanning operation on the even scan-lines in the first direction.

In exemplary embodiments, the scan driving unit may sequentially write a first data signal constituting a (2k−1)th image frame, where k is an integer greater than or equal to 1, into the pixel circuits coupled to the scan-lines by sequentially performing a scanning operation on the scan-lines in a first direction, and may sequentially write a second data signal constituting a (2k)th image frame into the pixel circuits coupled to the scan-lines by sequentially performing the scanning operation on the scan-lines in a second direction.

Therefore, a method of driving an organic light emitting display device according to exemplary embodiments may control an average emission waiting time of pixel circuits coupled to odd scan-lines and an average emission waiting time of pixel circuits coupled to even scan-lines so as to be close to an average emission waiting time of pixel circuits coupled to all scan-lines by changing a direction of the scanning operation during one image frame, or by changing a direction of the scanning operation during adjacent image frames. As a result, the luminance uniformity of a display panel included in the organic light emitting display device may be improved.

In addition, an organic light emitting display device according to exemplary embodiments may display a high-quality image based on a method of driving an organic light emitting display device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE EMBODIMENTS

Figure 1:
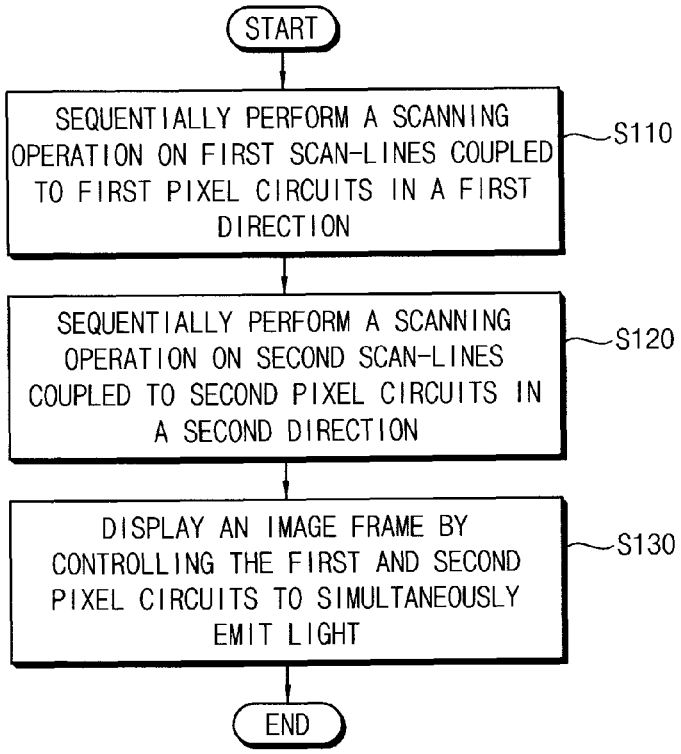
FIG. 1 is a flow chart illustrating a method of driving an organic light emitting display device according to exemplary embodiments.

Various exemplary embodiments will be described more fully hereinafter with reference to the accompanying drawings, in which some exemplary embodiments are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present invention. As used herein, the term "and/or" includes any and all combinations of one or more of the associated listed items.

It will be understood that, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
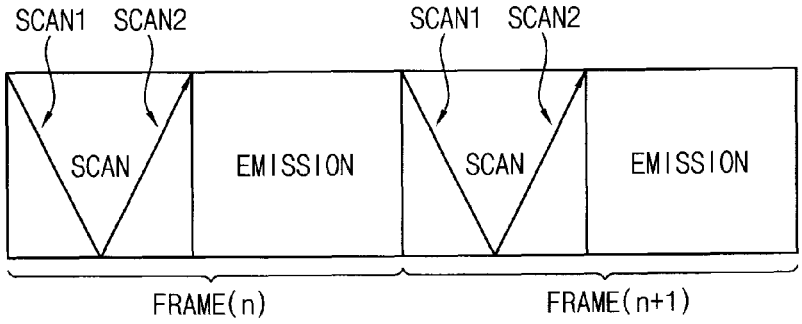
FIG. 2 is a diagram illustrating an exemplary in which an organic light emitting display device is driven by a method of FIG. 1.

FIG. 1 is a flow chart illustrating a method of driving an organic light emitting display device according to exemplary embodiments. FIG. 2 is a diagram illustrating an example in which an organic light emitting display device is driven by a method of FIG. 1.

Referring to FIGS. 1 and 2, the method of FIG. 1 may sequentially write a first data signal constituting an image frame FRAME(n) into first pixel circuits coupled to first scan-lines by sequentially performing a scanning operation on the first scan-lines in a first direction (i.e., indicated as SCAN1) (Step S110), may sequentially write a second data signal constituting the image frame FRAME(n) into second pixel circuits coupled to second scan-lines by sequentially performing the scanning operation on the second scan-lines in a second direction (i.e., indicated as SCAN2) (Step S120), and then may display the image frame FRAME(n) by controlling the first and second pixel circuits to simultaneously emit light (Step S130).

As illustrated in FIG. 2, the organic light emitting display device may employ a simultaneous emission driving technique. Generally, in the simultaneous emission driving technique, a frame operation period for displaying one image frame FRAME(n) may include an initialization period for performing an initializing operation, a reset period for performing a resetting operation, a threshold voltage compensation period for performing a threshold voltage compensating operation, a scan period for performing a scanning operation, and an emission period for performing a light emitting operation. For convenience of descriptions, only the scan period SCAN and the emission period EMISSION are illustrated in FIG. 2. In the latter regard, during the scan period SCAN, the scanning operation may be sequentially performed for all pixel circuits by each scan-line. On the other hand, during the emission period EMISSION, the light emitting operation may be simultaneously performed for all pixel circuits. As a result, an emission waiting time of the pixel circuits coupled to upper scan-lines (or lower scan-lines) may be longer than an emission waiting time of the pixel circuits coupled to the lower scan-lines (or the upper scan-lines) if the scanning operation is sequentially performed in a direction from a top scan-line to a bottom scan-line or from the bottom scan-line to the top scan-line. Thus, a difference between these emission waiting times may change a data voltage stored in a storage capacitor of respective pixel circuits, and thus may degrade a luminance uniformity of a display panel included in the organic light emitting display device. To overcome these problems, the method of FIG. 1 may improve the luminance uniformity of the display panel by changing a direction of the scanning operation during one image frame FRAME(n).

Specifically, the method of FIG. 1 may sequentially write the first data signal constituting the image frame FRAME(n) into the first pixel circuits coupled to the first scan-lines by sequentially performing the scanning operation on the first scan-lines in the first direction (i.e., indicated as SCAN1) (Step S110), and then may sequentially write the second data signal constituting the image frame FRAME(n) into the second pixel circuits coupled to the second scan-lines by sequentially performing the scanning operation on the second scan-lines in the second direction (i.e., indicated as SCAN2) (Step S120). In one exemplary embodiment, the first scan-lines may correspond to odd scan-lines, and the second scan-lines may correspond to even scan-lines. In another exemplary embodiment, the first scan-lines may correspond to even scan-lines, and the second scan-lines may correspond to odd scan-lines. As described above, the first data signal and the second data signal constitute one image frame (i.e., indicated as FRAME(n) or FRAME(n+1)). Therefore, the first data signal indicates a data signal that is written into the first pixel circuits coupled to the first scan-lines (i.e., odd scan-lines or even scan-lines), and the second data signal indicates a data signal that is written into the second pixel circuits coupled to the second scan-lines (i.e., even scan-lines or odd scan-lines). In addition, the first direction may be opposite to the second direction. In one exemplary embodiment, the first direction may correspond to a direction from the top scan-line to the bottom scan-line, and the second direction may correspond to a direction from the bottom scan-line to the top scan-line. In another exemplary embodiment, the first direction may correspond to a direction from the bottom scan-line to the top scan-line, and the second direction may correspond to a direction from the top scan-line to the bottom scan-line. It is illustrated in FIG. 1 that the first direction corresponds to a direction from the top scan-line to the bottom scan-line (i.e., indicated as SCAN1), and the second direction corresponds to a direction from the bottom scan-line to the top scan-line (i.e., indicated as SCAN2).

Next, the method of FIG. 1 may display the image frame FRAME(n) by controlling the first and second pixel circuits to simultaneously emit light (Step S130). Thus, the method of FIG. 1 may control an average emission waiting time of pixel circuits coupled to odd scan-lines and an average emission waiting time of pixel circuits coupled to even scan-lines so as to be close to an average emission waiting time of pixel circuits coupled to all scan-lines during one image frame FRAME(n) by setting a direction of the scanning operation performed on odd scan-lines during one image frame FRAME(n) so as to be opposite to a direction of the scanning operation performed on even scan-lines during the image frame FRAME(n) (i.e., by changing a direction of the scanning operation during one image frame FRAME(n)). In other words, as illustrated in FIG. 2, when the scanning operation is sequentially performed on odd scan-lines in a direction from the top scan-line to the bottom scan-line (i.e., indicated as SCAN1), and then the scanning operation is sequentially performed on even scan-lines in a direction from the bottom scan-line to the top scan-line (i.e., indicated as SCAN2), an emission waiting time of pixel circuits coupled to odd upper scan-lines is relatively long, but an emission waiting time of pixel circuits coupled to even upper scan-lines is relatively short. In addition, an emission waiting time of pixel circuits coupled to odd lower scan-lines is relatively short, but an emission waiting time of pixel circuits coupled to even lower scan-lines is relatively long. Accordingly, the luminance uniformity of the display panel may be improved when one image frame FRAME(n) is displayed on the display panel. As a result, the method of FIG. 1 may achieve a high luminance uniformity of the display panel included in the organic light emitting display device.

Figure 3:
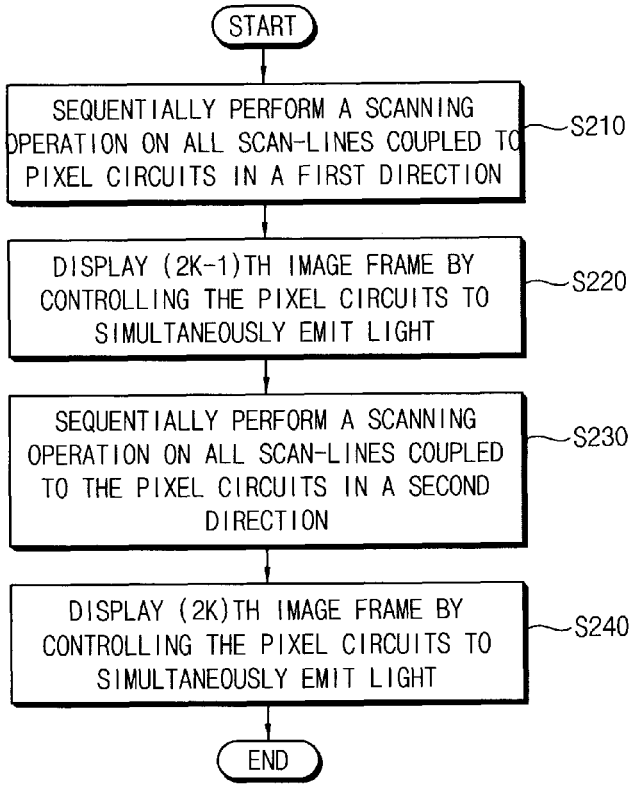
FIG. 3 is a flow chart illustrating a method of driving an organic light emitting display device according to exemplary embodiments.
Figure 4:
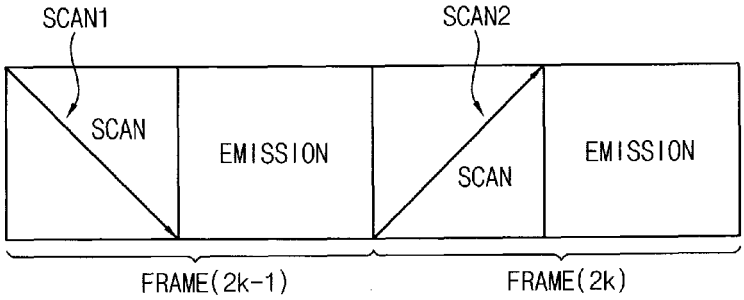
FIG. 4 is a diagram illustrating an example in which an organic light emitting display device is driven by a method of FIG. 3.

FIG. 3 is a flow chart illustrating a method of driving an organic light emitting display device according to exemplary embodiments. FIG. 4 is a diagram illustrating an example in which an organic light emitting display device is driven by a method of FIG. 3.

Referring to FIGS. 3 and 4, the method of FIG. 3 may sequentially write a first data signal constituting a (2k−1)th image frame FRAME(2k−1), where k is an integer greater than or equal to 1, into pixel circuits coupled to all scan-lines by sequentially performing a scanning operation on the scan-lines in a first direction (i.e., indicated as SCAN1) (Step S210), and then may display the (2k−1)th image frame FRAME(2k−1) by controlling the pixel circuits to simultaneously emit light (Step S220). Next, the method of FIG. 3 may sequentially write a second data signal constituting a (2k)th image frame FRAME(2k) into the pixel circuits coupled to all scan-lines by sequentially performing the scanning operation on the scan-lines in a second direction (i.e., indicated as SCAN2) (Step S230), and then may display the (2k)th image frame FRAME(2k) by controlling the pixel circuits to simultaneously emit light (Step S240). Thus, the method of FIG. 3 may improve the luminance uniformity of a display panel included in the organic light emitting display device by changing a direction of the scanning operation during adjacent image frames FRAME(2k−1) and FRAME (2k). For convenience of descriptions, only a scan period SCAN and an emission period EMISSION are illustrated in FIG. 4.

Specifically, the method of FIG. 3 may sequentially write the first data signal constituting the (2k−1)th image frame FRAME(2k−1) into the pixel circuits coupled to all scan-lines by sequentially performing the scanning operation on the scan-lines in the first direction (i.e., indicated as SCAN1) (Step S210), and then may display the (2k−1)th image frame FRAME(2k−1) by controlling the pixel circuits to simultaneously emit light (Step S220). Here, the method of FIG. 3 may perform the scanning operation on the scan-lines in the same way as conventional sequential emission driving techniques when displaying the (2k−1)th image frame FRAME (2k−1). In addition, the method of FIG. 3 may perform the scanning operation on the scan-lines in the same way as conventional sequential emission driving techniques when displaying the (2k)th image frame FRAME(2k). However, a direction of the scanning operation performed on the scan-lines during the (2k−1)th image frame FRAME(2k−1) is opposite to a direction of the scanning operation performed on the scan-lines during the (2k)th image frame FRAME(2k). Therefore, the method of FIG. 3 may sequentially write the second data signal constituting the (2k)th image frame FRAME(2k) into the pixel circuits coupled to all scan-lines by sequentially performing the scanning operation on the scan-lines in the second direction (i.e., indicated as SCAN2) (Step S230), and then may display the (2k)th image frame FRAME(2k) by controlling the pixel circuits to simultaneously emit light (Step S240).

As described above, the scan-lines include first scan-lines (i.e., odd scan-lines or even scan-lines) and second scan-lines (i.e., even scan-lines and odd scan-lines). In addition, the first data signal solely constitutes one image frame (i.e., FRAME (2k−1)), and the second data signal solely constitutes one image frame (i.e., FRAME(2k)). Therefore, the first data signal indicates a data signal that is written into the pixel circuits coupled to all scan-lines during the (2k−1)th image frame FRAME(2k−1), and the second data signal indicates a data signal that is written into the pixel circuits coupled to all scan-lines during the (2k)th image frame FRAME(2k). In one exemplary embodiment, the first direction may correspond to a direction from the top scan-line to the bottom scan-line, and the second direction may correspond to a direction from the bottom scan-line to the top scan-line. In another exemplary embodiment, the first direction may correspond to a direction from the bottom scan-line to the top scan-line, and the second direction may correspond to a direction from the top scan-line to the bottom scan-line. It is illustrated in FIG. 4 that the first direction corresponds to a direction from the top scan-line to the bottom scan-line (i.e., indicated as SCAN1), and the second direction corresponds to a direction from the bottom scan-line to the top scan-line (i.e., indicated as SCAN2).

Thus, the method of FIG. 3 may control the average emission waiting time of pixel circuits coupled to odd scan-lines and the average emission waiting time of pixel circuits coupled to even scan-lines so as to be close to an average emission waiting time of pixel circuits coupled to all scan-lines during adjacent image frames FRAME(2k−1) and FRAME(2k) by setting a direction of the scanning operation performed on the scan-lines during the (2k−1)th image frame FRAME(2k−1) so as to be opposite to a direction of the scanning operation performed on the scan-lines during the (2k)th image frame FRAME(2k) (i.e., by changing a direction of the scanning operation during adjacent image frames FRAME(2k−1) and FRAME(2k)). In other words, as illustrated in FIG. 4, when the scanning operation is sequentially performed on the scan-lines in a direction from the top scan-line to the bottom scan-line during the (2k−1)th image frame FRAME(2k−1) (i.e., indicated as SCAN1), and then the scanning operation is sequentially performed on the scan-lines in a direction from the bottom scan-line to the top scan-line during the (2k)th image frame FRAME(2k) (i.e., indicated as SCAN2), an emission waiting time of pixel circuits coupled to upper scan-lines is relatively long, but an emission waiting time of pixel circuits coupled to lower scan-lines is relatively short during the (2k−1)th image frame FRAME(2k−1). In addition, an emission waiting time of pixel circuits coupled to upper scan-lines is relatively short, but an emission waiting time of pixel circuits coupled to lower scan-lines is relatively long during the (2k)th image frame FRAME(2k). Accordingly, a luminance uniformity of the display panel may be improved when adjacent image frames FRAME(2k−1) and FRAME(2k) are displayed on the display panel. As a result, the method of FIG. 3 may achieve a high luminance uniformity of the display panel included in the organic light emitting display device.

Figure 5:
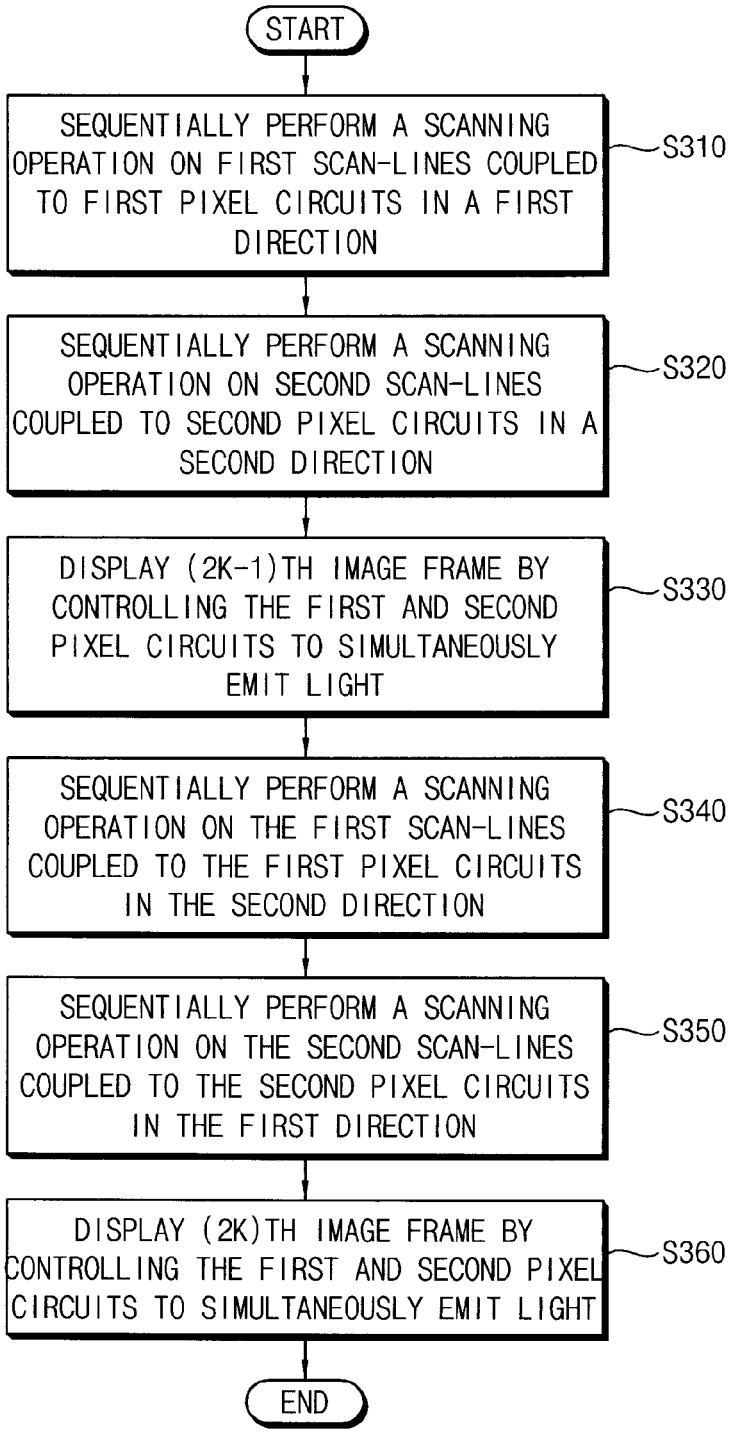
FIG. 5 is a flow chart illustrating a method of driving an organic light emitting display device according to exemplary embodiments.
Figure 6:
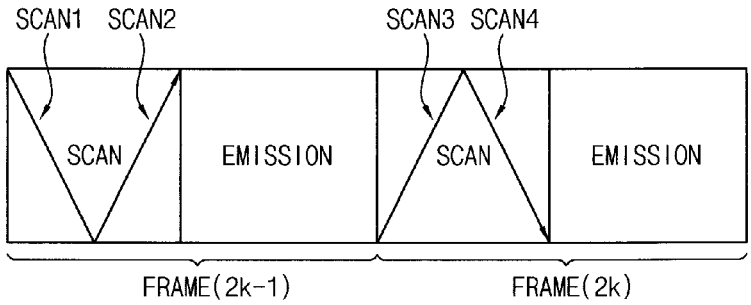
FIG. 6 is a diagram illustrating an example in which an organic light emitting display device is driven by a method of FIG. 5.

FIG. 5 is a flow chart illustrating a method of driving an organic light emitting display device according to exemplary embodiments. FIG. 6 is a diagram illustrating an example in which an organic light emitting display device is driven by a method of FIG. 5.

Referring to FIGS. 5 and 6, the method of FIG. 5 may sequentially write a first data signal constituting a (2k−1)th image frame FRAME(2k−1), where k is an integer greater than or equal to 1, into first pixel circuits coupled to first scan-lines by sequentially performing a scanning operation on the first scan-lines in a first direction (i.e., indicated as SCAN1) (Step S310), may sequentially write a second data signal constituting the (2k−1)th image frame FRAME(2k−1) into second pixel circuits coupled to second scan-lines by sequentially performing the scanning operation on the second scan-lines in a second direction (i.e., indicated as SCAN2) (Step S320), and then may display the (2k−1)th image frame FRAME(2k−1) by controlling the first and second pixel circuits so as to simultaneously emit light (Step S330). Next, the method of FIG. 5 may sequentially write a third data signal constituting a (2k)th image frame FRAME(2k) into the first pixel circuits coupled to the first scan-lines by sequentially performing the scanning operation on the first scan-lines in the second direction (i.e., indicated as SCAN3) (Step S340), may sequentially write a fourth data signal constituting the (2k)th image frame FRAME(2k) into the second pixel circuits coupled to the second scan-lines by sequentially performing the scanning operation on the second scan-lines in the first direction (i.e., indicated as SCAN4) (Step S350), and then may display the (2k)th image frame FRAME(2k) by controlling the first and second pixel circuits so as to simultaneously emit light (Step S360). Thus, the method of FIG. 5 may improve the luminance uniformity of a display panel included in the organic light emitting display device by changing a direction of the scanning operation during adjacent image frames FRAME(2k−1) and FRAME(2k), as well as by changing a direction of the scanning operation during respective image frames FRAME(2k−1) and FRAME(2k). For convenience of descriptions, only a scan period SCAN and an emission period EMISSION are illustrated in FIG. 6.

Specifically, the method of FIG. 5 may sequentially write the first data signal constituting the (2k−1)th image frame FRAME(2k−1) into the first pixel circuits coupled to the first scan-lines by sequentially performing the scanning operation on the first scan-lines in the first direction (i.e., indicated as SCAN1) (Step S310), may sequentially write the second data signal constituting the (2k−1)th image frame FRAME(2k−1) into the second pixel circuits coupled to the second scan-lines by sequentially performing the scanning operation on the second scan-lines in the second direction (i.e., indicated as SCAN2) (Step S320), and then may display the (2k−1)th image frame FRAME(2k−1) by controlling the first and second pixel circuits so as to simultaneously emit light (Step S330). In one exemplary embodiment, the first scan-lines may correspond to odd scan-lines, and the second scan-lines may correspond to even scan-lines. In another exemplary embodiment, the first scan-lines may correspond to even scan-lines, and the second scan-lines may correspond to odd scan-lines. Here, the first data signal and the second data signal constitute one image frame (i.e., indicated as FRAME (2k−1)). Therefore, the first data signal indicates a data signal that is written into the first pixel circuits coupled to the first scan-lines (i.e., odd scan-lines or even scan-lines), and the second data signal indicates a data signal that is written into the second pixel circuits coupled to the second scan-lines (i.e., even scan-lines or odd scan-lines). In addition, the first direction may be opposite to the second direction. In one exemplary embodiment, the first direction may correspond to a direction from the top scan-line to the bottom scan-line, and the second direction may correspond to a direction from the bottom scan-line to the top scan-line. In another exemplary embodiment, the first direction may correspond to a direction from the bottom scan-line to the top scan-line, and the second direction may correspond to a direction from the top scan-line to the bottom scan-line. As illustrated in FIG. 6, the first direction corresponds to a direction from the top scan-line to the bottom scan-line, and the second direction corresponds to a direction from the bottom scan-line to the top scan-line.

Next, the method of FIG. 5 may set a direction of the scanning operation performed on the first and second scan-lines during the (2k−1)th image frame FRAME(2k−1) to be opposite to a direction of the scanning operation performed on the first and second scan-lines during the (2k)th image frame FRAME(2k). Thus, the method of FIG. 5 may sequentially write the third data signal constituting the (2k)th image frame FRAME(2k) into the first pixel circuits coupled to the first scan-lines by sequentially performing the scanning operation on the first scan-lines in the second direction (i.e., indicated as SCAN3) (Step S340), may sequentially write the fourth data signal constituting the (2k)th image frame FRAME(2k) into the second pixel circuits coupled to the second scan-lines by sequentially performing the scanning operation on the second scan-lines in the first direction (i.e., indicated as SCAN4) (Step S350), and then may display the (2k)th image frame FRAME(2k) by controlling the first and second pixel circuits so as to simultaneously emit light (Step S360). Similarly, the third data signal and the fourth data signal constitute one image frame (i.e., indicated as FRAME (2k)). Therefore, the third data signal indicates a data signal that is written into the first pixel circuits coupled to the first scan-lines (i.e., odd scan-lines or even scan-lines), and the fourth data signal indicates a data signal that is written into the second pixel circuits coupled to the second scan-lines (i.e., even scan-lines or odd scan-lines). As described above, the first direction may be opposite to the second direction. That is, as illustrated in FIG. 6, a direction of the scanning operation performed on the first and second scan-lines during the (2k−1)th image frame FRAME(2k−1) may be opposite to a direction of the scanning operation performed on the first and second scan-lines during the (2k)th image frame FRAME (2k). In one exemplary embodiment, the first direction may correspond to a direction from the top scan-line to the bottom scan-line, and the second direction may correspond to a direction from the bottom scan-line to the top scan-line. In another exemplary embodiment, the first direction may correspond to a direction from the bottom scan-line to the top scan-line, and the second direction may correspond to a direction from the top scan-line to the bottom scan-line.

Thus, the method of FIG. 5 may control an average emission waiting time of pixel circuits coupled to odd scan-lines and an average emission waiting time of pixel circuits coupled to even scan-lines so as to be close to an average emission waiting time of pixel circuits coupled to all scan-lines during adjacent image frames FRAME(2k−1) and FRAME(2k) by setting a direction of the scanning operation performed on odd scan-lines during the (2k−1)th image frame FRAME(2k−1) to be opposite to a direction of the scanning operation performed on even scan-lines during the (2k−1)th image frame FRAME(2k−1), by setting a direction of the scanning operation performed on odd scan-lines during the (2k)th image frame FRAME(2k) to be opposite to a direction of the scanning operation performed on even scan-lines during the (2k)th image frame FRAME(2k), by setting a direction of the scanning operation performed on odd scan-lines during the (2k−1)th image frame FRAME(2k−1) to be opposite to a direction of the scanning operation performed on odd scan-lines during the (2k)th image frame FRAME(2k), and by setting a direction of the scanning operation performed on even scan-lines during the (2k−1)th image frame FRAME (2k−1) to be opposite to a direction of the scanning operation performed on even scan-lines during the (2k)th image frame FRAME(2k). Accordingly, the luminance uniformity of the display panel may be improved when adjacent image frames FRAME(2k−1) and FRAME(2k) are displayed on the display panel. As a result, the method of FIG. 5 may achieve a high luminance uniformity of the display panel included in the organic light emitting display device.

Figure 7:
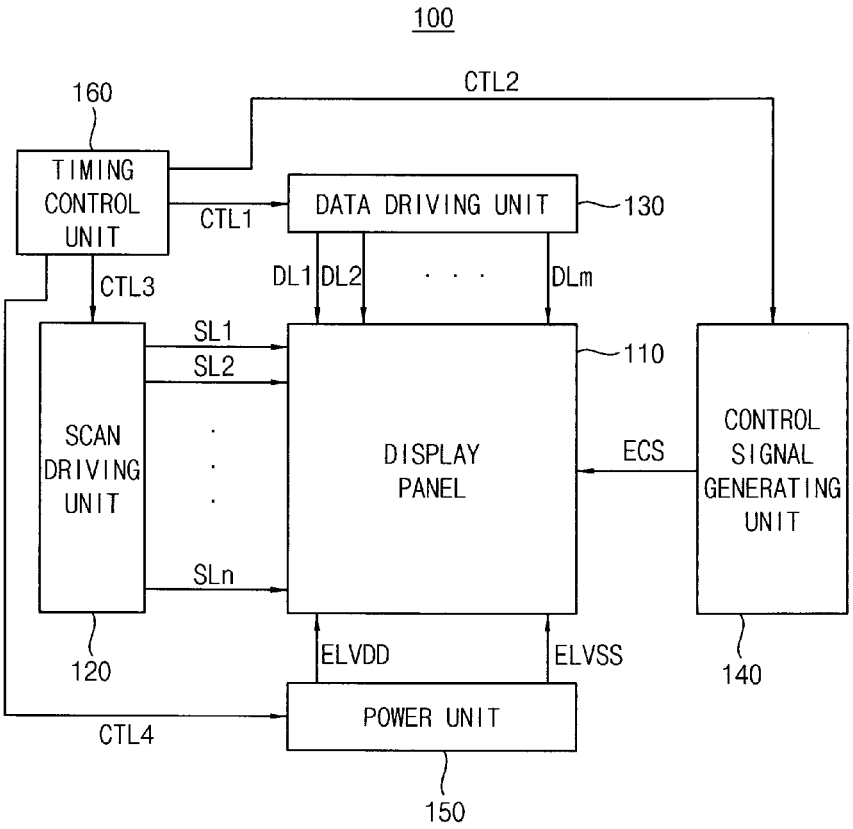
FIG. 7 is a block diagram illustrating an organic light emitting display device according to exemplary embodiments.
Figure 8:
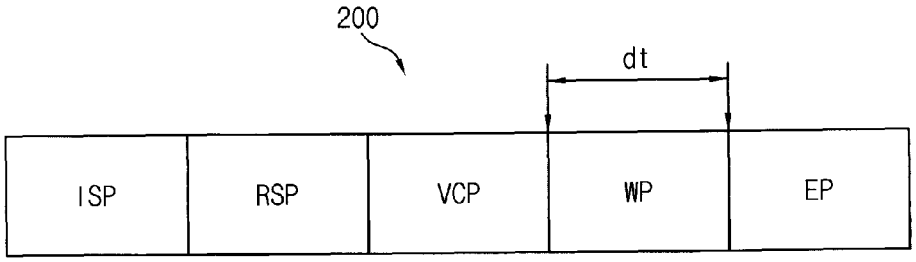
FIG. 8 is a diagram illustrating a frame operation period for displaying one image frame in an organic light emitting display device of FIG. 7.

FIG. 7 is a block diagram illustrating an organic light emitting display device according to exemplary embodiments. FIG. 8 is a diagram illustrating a frame operation period for displaying one image frame in an organic light emitting display device of FIG. 7.

Referring to FIGS. 7 and 8, the organic light emitting display device 100 may employ a simultaneous emission driving technique. For this operation, the organic light emitting display device 100 may include a display panel 110, a scan driving unit 120, a data driving unit 130, a control signal generating unit 140, a power unit 150, and a timing control unit 160.

The display panel 110 may include a plurality of pixel circuits. Specifically, the pixel circuits may be arranged at locations corresponding to crossing points of a plurality of scan-lines SL1 through SLn and a plurality of data-lines DL1 through DLm. In the display panel 110, the scan-lines SL1 through SLn that transmit a scan signal may be formed in a first arrangement direction (e.g., X-axis direction in FIG. 7), the data-lines DL1 through DLm that transmit a data signal may be formed in a second arrangement direction (e.g., Y-axis direction in FIG. 7), and a plurality of power-lines that transmit a high power voltage ELVDD and a low power voltage ELVSS may be formed in the first arrangement direction or the second arrangement direction.

The scan driving unit 120 may provide the scan signal to the pixel circuits of the display panel 110 via the scan-lines SL1 through SLn. Generally, as illustrated in FIG. 8, a frame operation period 200 for displaying one image frame may include an initialization period ISP for performing an initializing operation, a reset period RSP for performing a resetting operation, a threshold voltage compensation period VCP for performing a threshold voltage compensating operation, a scan period WP for performing a scanning operation, and an emission period EP for performing a light emitting operation. Here, each of the initializing operation, the resetting operation, the threshold voltage compensating operation, and the light emitting operation may be simultaneously performed for all pixel circuits, whereas the scanning operation may be sequentially performed for all pixel circuits by each scan-line (e.g., in order of SL1 through SLn). As a result, a difference dt between an emission waiting time of the pixel circuits coupled to a scan-line SL1 through SLn on which the first scanning operation is performed and an emission waiting time of the pixel circuits coupled to another scan-line SL1 through SLn on which the last scanning operation is performed may occur in the scan period WP. In addition, the difference dt between these emission waiting times may result in a voltage drop due to a leakage current, etc (i.e., a change of a data voltage stored in a storage capacitor of respective pixel circuits). As a result, the luminance uniformity of a display panel included in an organic light emitting display device may be greatly degraded. Thus, in the organic light emitting display device 100, the scan driving unit 120 may control an average emission waiting time of pixel circuits coupled to odd scan-lines (i.e., SL1, SL3, . . . ) and an average emission waiting time of pixel circuits coupled to even scan-lines (i.e., SL2, SL4, . . . ) so as to be close to an average emission waiting time of pixel circuits coupled to all scan-lines SL1 through SLn by changing a direction of the scanning operation during one image frame, or by changing a direction of the scanning operation during adjacent image frames. As a result, the luminance uniformity of the display panel 110 included in the organic light emitting display device 100 may be improved.

In one exemplary embodiment, the scan driving unit 120 may sequentially write a first data signal constituting an image frame into first pixel circuits coupled to odd scan-lines (i.e., SL1, SL3, . . . ) by sequentially performing the scanning operation on odd scan-lines (i.e., SL1, SL3, . . . ) in a first direction, and may sequentially write a second data signal constituting the image frame into second pixel circuits coupled to even scan-lines (i.e., SL2, SL4, . . . ) by sequentially performing the scanning operation on even scan-lines (i.e., SL2, SL4, . . . ) in a second direction. In another exemplary embodiment, the scan driving unit 120 may sequentially write a first data signal constituting the (2k−1)th image frame into first pixel circuits coupled to odd scan-lines (i.e., SL1, SL3, . . . ) by sequentially performing the scanning operation on odd scan-lines (i.e., SL1, SL3, . . . ) in a first direction, and may sequentially write a second data signal constituting the (2k−1)th image frame into second pixel circuits coupled to even scan-lines (i.e., SL2, SL4, . . . ) by sequentially performing the scanning operation on even scan-lines (i.e., SL2, SL4, . . . ) in a second direction. Next, the scan driving unit 120 may sequentially write a third data signal constituting the (2k)th image frame into the first pixel circuits coupled to odd scan-lines (i.e., SL1, SL3, . . . ) by sequentially performing the scanning operation on odd scan-lines (i.e., SL1, SL3, . . . ) in the second direction, and may sequentially write a fourth data signal constituting the (2k)th image frame into the second pixel circuits coupled to even scan-lines (i.e., SL2, SL4, . . . ) by sequentially performing the scanning operation on even scan-lines (i.e., SL2, SL4, . . . ) in the first direction. In still another exemplary embodiment, the scan driving unit 120 may sequentially write a first data signal constituting the (2k−1)th image frame into pixel circuits coupled to all scan-lines SL1 through SLn by sequentially performing the scanning operation on the scan-lines SL1 through SLn in a first direction. Next, the scan driving unit 120 may sequentially write a second data signal constituting the (2k)th image frame into the pixel circuits coupled to all scan-lines SL1 through SLn by sequentially performing the scanning operation on the scan-lines SL1 through SLn in a second direction. Here, the first direction may correspond to a direction from the top scan-line to the bottom scan-line, and the second direction may correspond to a direction from the bottom scan-line to the top scan-line. Alternatively, the first direction may correspond to a direction from the bottom scan-line to the top scan-line, and the second direction may correspond to a direction from the top scan-line to the bottom scan-line.

The data driving unit 130 may provide a data signal to the pixel circuits of the display panel 110 via the data-lines DL1 through DLm. The control signal generating unit 140 may provide an emission control signal ECS to the pixel circuits of the display panel 110. The emission control signal ECS may control the pixel circuits to simultaneously emit light. The power unit 150 may provide a high power voltage ELVDD and a low power voltage ELVSS to the pixel circuits of the display panel 110. The timing control unit 160 may generate first through fourth control signals CTL1, CTL2, CTL3, and CTL4, and may provide the first through fourth control signals CTL1, CTL2, CTL3, and CTL4 to the data driving unit 130, the control signal generating unit 140, the scan driving unit 120, and the power unit 150 so as to control the data driving unit 130, the control signal generating unit 140, the scan driving unit 120, and the power unit 150. As described above, the organic light emitting display device 100 may control an average emission waiting time of pixel circuits coupled to odd scan-lines (i.e., SL1, SL3, . . . ) and an average emission waiting time of pixel circuits coupled to even scan-lines (i.e., SL2, SL4, . . . ) so as to be close to an average emission waiting time of pixel circuits coupled to all scan-lines SL1 through SLn by setting a direction of the scanning operation performed on odd scan-lines (i.e., SL1, SL3, . . . ) to be opposite to a direction of the scanning operation performed on even scan-lines (i.e., SL2, SL4, . . . ) during one image frame (i.e., by changing a direction of the scanning operation during one image frame). In addition, the organic light emitting display device 100 may control an average emission waiting time of pixel circuits coupled to odd scan-lines (i.e., SL1, SL3, . . . ) and an average emission waiting time of pixel circuits coupled to even scan-lines (i.e., SL2, SL4, . . . ) so as to be close to an average emission waiting time of pixel circuits coupled to all scan-lines SL1 through SLn by setting a direction of the scanning operation performed on all scan-lines SL1 through SLn to be opposite to a direction of the scanning operation performed on all scan-lines SL1 through SLn during adjacent image frames (i.e., by changing a direction of the scanning operation during adjacent image frames). As a result, the luminance uniformity of the display panel 110 included in the organic light emitting display device 100 may be improved. Thus, the organic light emitting display device 100 may display (i.e., output) a high-quality image.

Figure 9:
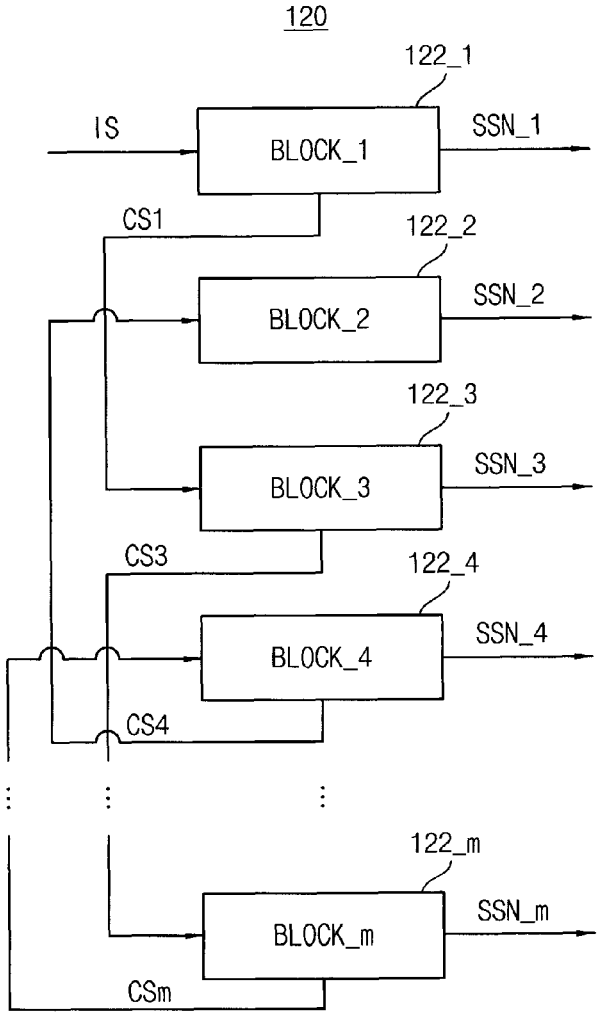
FIG. 9 is a diagram illustrating an example in which a scan driving unit of an organic light emitting display device of FIG. 7 operates.

FIG. 9 is a diagram illustrating an example in which a scan driving unit of an organic light emitting display device of FIG. 7 operates.

Referring to FIG. 9, the scan driving unit 120 of the organic light emitting display device 100 of FIG. 7 may include first through (m) th output blocks 122_1 through **122_*m*. Here, the first through (m) th output blocks 122_1 through 122_*m* may output first through (m) th scan signals SSN_1** through SSN_m, respectively.

As illustrated in FIG. 9, the scan driving unit 120 may sequentially perform a scanning operation on odd scan-lines (i.e., SL1, SL3, . . . ) in a first direction (e.g., a direction from the top scan-line to the bottom scan-line), and then may sequentially perform the scanning operation on even scan-lines (i.e., SL2, SL4, . . . ) in a second direction (i.e., a direction from the bottom scan-line to the top scan-line) during one image frame. Specifically, when the scan driving unit 120 performs the scanning operation on the scan-lines SL1 through SLn, the first output block 122_1 may output the first scan signal SSN_1 in response to an initial control signal IS, and then the third output block 122_3 may output the third scan signal SSN_3 in response to a sequential control signal CS1 outputted from the first output block 122_1. In this way, the scan driving unit 120 may perform the scanning operation on odd scan-lines (i.e., SL1, SL3, . . . ) in a first direction (e.g., a direction from the top scan-line to the bottom scan-line). On the other hand, the fourth output block 122_4 may output the fourth scan signal SSN_4 in response to a sequential control signal CS6 outputted from the sixth output block 122_6, and then the second output block 122_2 may output the second scan signal SSN_2 in response to a sequential control signal CS4 outputted from the fourth output block 122_4. In this way, the scan driving unit 120 may perform the scanning operation on even scan-lines (i.e., SL2, SL4, . . . ) in a second direction (e.g., a direction from the bottom scan-line to the top scan-line). Since a structure of the scan driving unit 120 illustrated in FIG. 9 is exemplary, the structure of the scan driving unit 120 is not limited thereto.

Figure 10A:
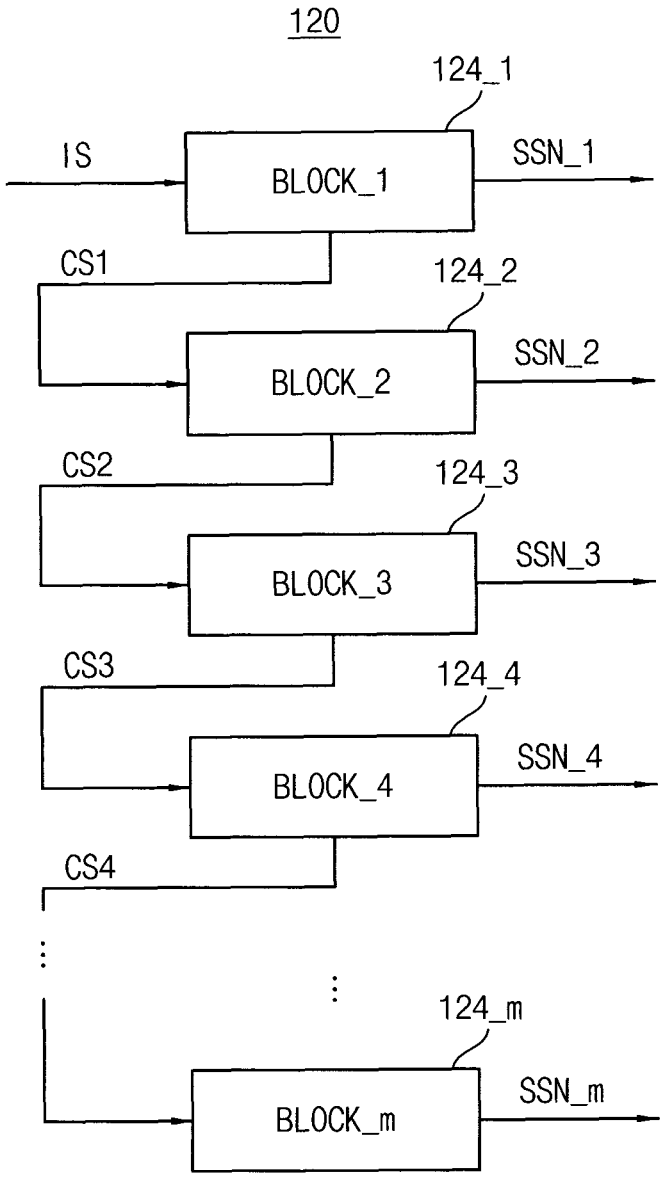
FIGS. 10A and 10B are diagrams illustrating another example in which a scan driving unit of an organic light emitting display device of FIG. 7 operates.
Figure 10B:
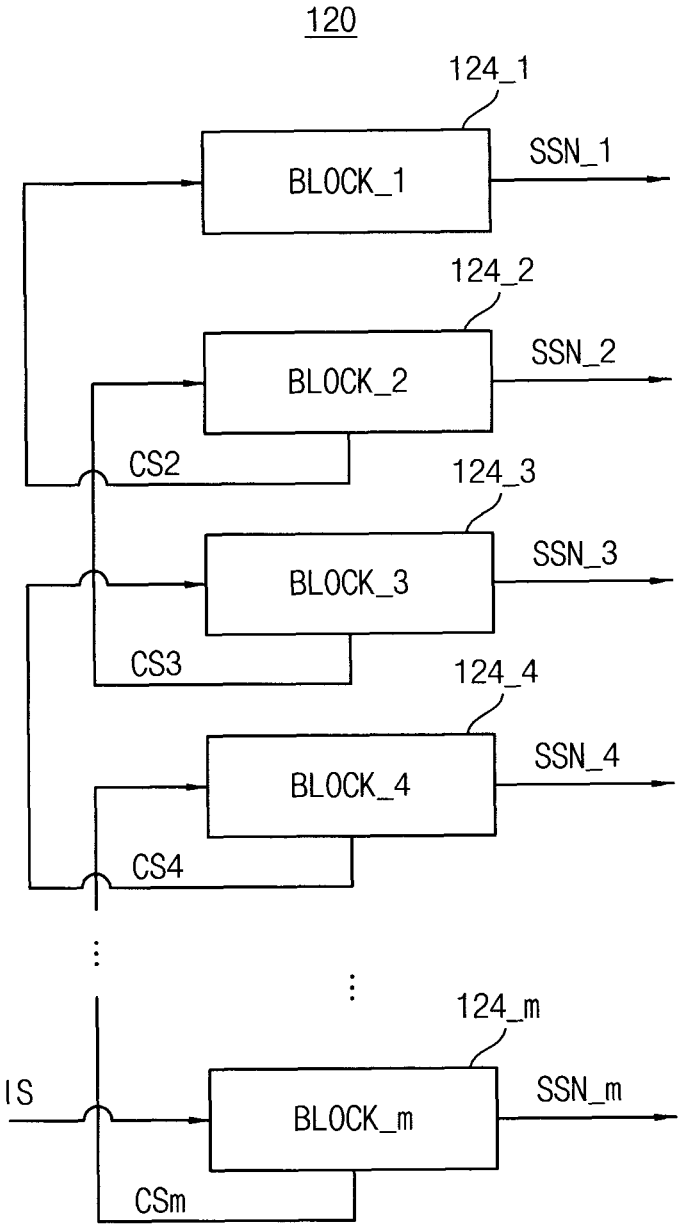

FIGS. 10A and 10B are diagrams illustrating another example in which a scan driving unit of an organic light emitting display device of FIG. 7 operates.

Referring to FIGS. 10A and 10B, the scan driving unit 120 of the organic light emitting display device 100 may include first through (m) th output blocks 124_1 through **124_*m*. Here, the first through (m) th output blocks 124_1 through 124_*m* may output first through (m) th scan signals SSN_1** through SSN_m, respectively.

As illustrated in FIG. 10A, the scan driving unit 120 may sequentially perform a scanning operation on all scan-lines SL1 through SLn in a first direction (e.g., a direction from the top scan-line to the bottom scan-line) during the (2k−1)th image frame. Specifically, when the scan driving unit 120 performs the scanning operation on the scan-lines SL1 through SLn, the first output block 124_1 may output the first scan signal SSN_1 in response to an initial control signal IS, the second output block 124_2 may output the second scan signal SSN_2 in response to a sequential control signal CS1 outputted from the first output block 124_1, and then the third output block 124_3 may output the third scan signal SSN_3 in response to a sequential control signal CS2 outputted from the second output block 124_2. In this way, the scan driving unit 120 may perform the scanning operation on the scan-lines SL1 through SLn in the first direction (e.g., a direction from the top scan-line to the bottom scan-line). On the other hand, as illustrated in FIG. 10B, the scan driving unit 120 may sequentially perform the scanning operation on all scan-lines SL1 through SLn in a second direction (e.g., a direction from the bottom scan-line to the top scan-line) during the (2k)th image frame. Specifically, when the scan driving unit 120 performs the scanning operation on the scan-lines SL1 through SLn, the (m) th output block 124_*m* may output the (m) th scan signal SSN_m in response to an initial control signal IS, the fourth output block 124_4 may output the fourth scan signal SSN_4 in response to a sequential control signal CSm outputted from the (m) th output block 124_*m*, the third output block 124_3 may output the third scan signal SSN_3 in response to a sequential control signal CS4 outputted from the fourth output block 124_4, and then the second output block 124_2 may output the second scan signal SSN_2 in response to a sequential control signal CS3 outputted from the third output block 124_3. In this way, the scan driving unit 120 may perform the scanning operation on the scan-lines SL1 through SLn in the second direction (e.g., a direction from the bottom scan-line to the top scan-line). Since a structure of the scan driving unit 120 illustrated in FIGS. 10A and 10B is exemplary, the structure of the scan driving unit 120 is not limited thereto.

Figure 11A:
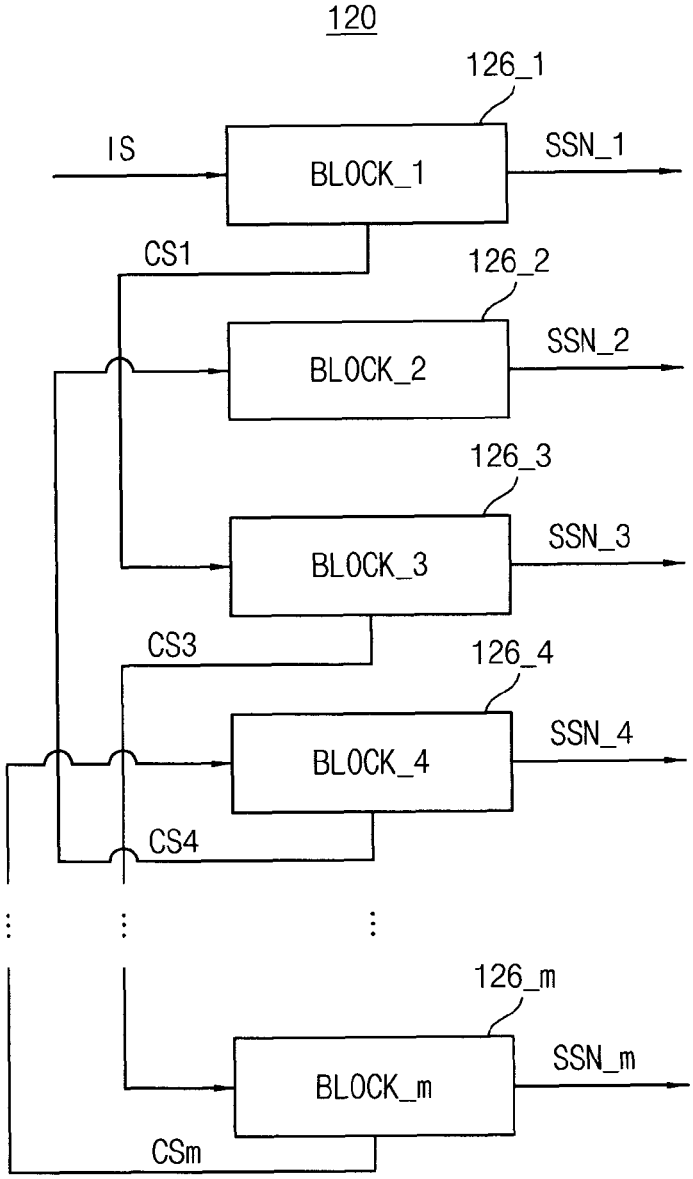
FIGS. 11A and 11B are diagrams illustrating still another example in which a scan driving unit of an organic light emitting display device of FIG. 7 operates.
Figure 11B:
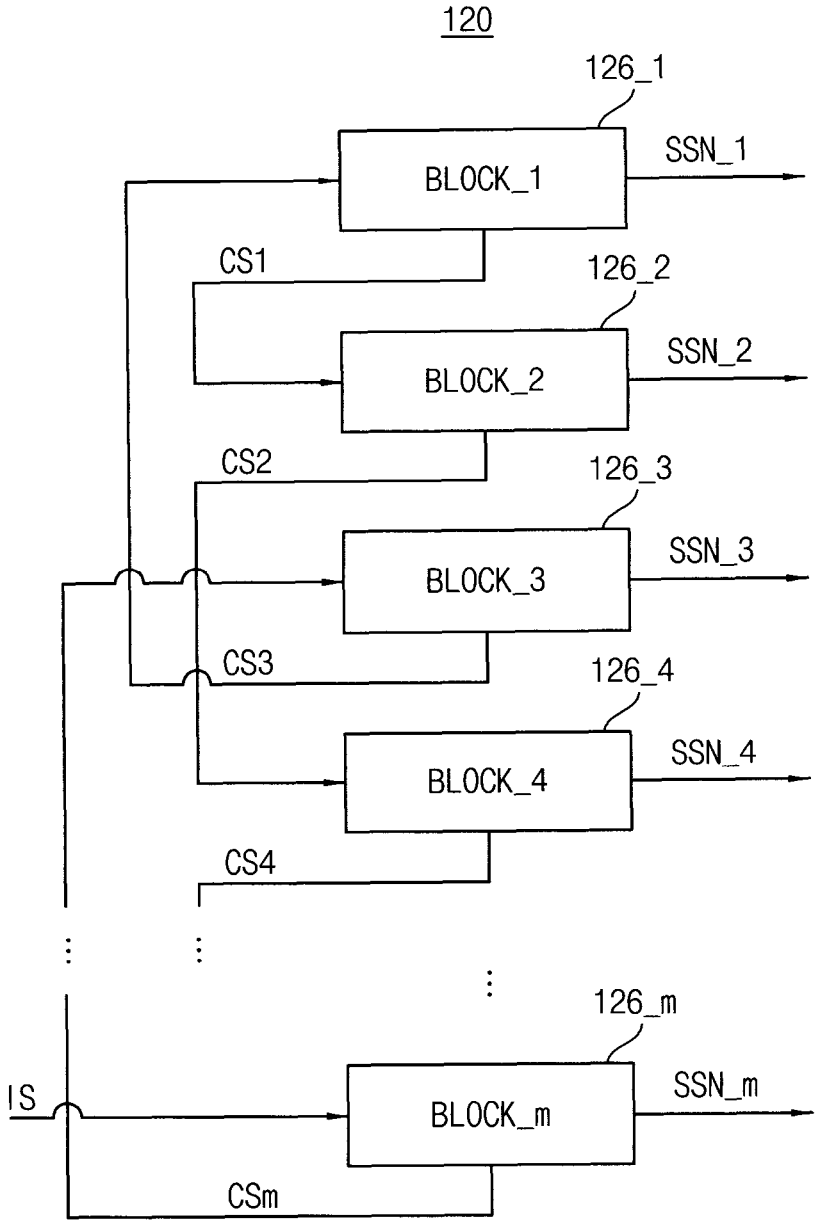

FIGS. 11A and 11B are diagrams illustrating still another example in which a scan driving unit of an organic light emitting display device of FIG. 7 operates.

Referring to FIGS. 11A and 11B, the scan driving unit 120 of the organic light emitting display device 100 may include first through (m) th output blocks 126_1 through 126_*m*. Here, the first through (m) th output blocks 126_1 through 126_*m* may output first through (m) th scan signals SSN_1 through SSN_m, respectively.

As illustrated in FIG. 11A, the scan driving unit 120 may sequentially perform a scanning operation on odd scan-lines (i.e., SL1, SL3, . . . ) in a first direction (e.g., a direction from the top scan-line to the bottom scan-line), and then may sequentially perform the scanning operation on even scan-lines (i.e., SL2, SL4, . . . ) in a second direction (e.g., a direction from the bottom scan-line to the top scan-line) during the (2k−1)th image frame. Specifically, when the scan driving unit 120 performs the scanning operation on the scan-lines SL1 through SLn, the first output block 126_1 may output the first scan signal SSN_1 in response to an initial control signal IS, and then the third output block 126_3 may output the third scan signal SSN_3 in response to a sequential control signal CS1 outputted from the first output block 126_1. In this way, the scan driving unit 120 may perform the scanning operation on odd scan-lines (i.e., SL1, SL3, . . . ) in the first direction (e.g., a direction from the top scan-line to the bottom scan-line). On the other hand, the fourth output block 126_4 may output the fourth scan signal SSN_4 in response to a sequential control signal CSm outputted from the (m) th output block 126_*m*, and then the second output block 126_2 may output the second scan signal SSN_2 in response to a sequential control signal CS4 outputted from the fourth output block 126_4. In this way, the scan driving unit 120 may perform the scanning operation on even scan-lines (i.e., SL2, SL4, . . . ) in the second direction (e.g., a direction from the bottom scan-line to the top scan-line).

As illustrated in FIG. 11B, the scan driving unit 120 may sequentially perform the scanning operation on odd scan-lines (i.e., SL1, SL3, . . . ) in the second direction (e.g., a direction from the bottom scan-line to the top scan-line), and then may sequentially perform the scanning operation on even scan-lines (i.e., SL2, SL4, . . . ) in the first direction (e.g., a direction from the top scan-line to the bottom scan-line) during the (2k)th image frame. Specifically, when the scan driving unit 120 performs the scanning operation on the scan-lines SL1 through SLn, the (m) th output block 126_*m* may output the (m) th scan signal SSN_m in response to an initial control signal IS, the third output block 126_3 may output the third scan signal SSN_3 in response to a sequential control signal CSm outputted from the (m) th output block 126_*m*, and then the first output block 126_1 may output the first scan signal SSN_1 in response to a sequential control signal CS3 outputted from the third output block 126_3. In this way, the scan driving unit 120 may perform the scanning operation on odd scan-lines (i.e., SL1, SL3, . . . ) in the second direction (e.g., a direction from the bottom scan-line to the top scan-line). On the other hand, the second output block 126_2 may output the second scan signal SSN_2 in response to a sequential control signal CS1 outputted from the first output block 126_1, and then the fourth output block 126_4 may output the fourth scan signal SSN_4 in response to a sequential control signal CS2 outputted from the second output block 126_2. In this way, the scan driving unit 120 may perform the scanning operation on even scan-lines (i.e., SL2, SL4, . . . ) in the first direction (e.g., a direction from the top scan-line to the bottom scan-line). Since the structure of the scan driving unit 120 illustrated in FIGS. 11A and 11B is exemplary, the structure of the scan driving unit 120 is not limited thereto.

Figure 12:
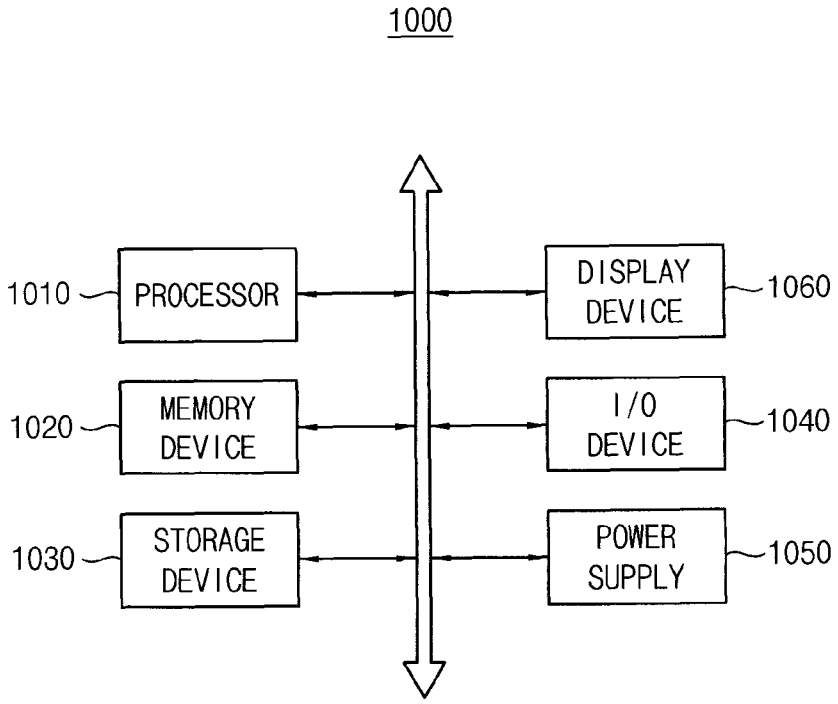
FIG. 12 is a block diagram illustrating an electronic device having an organic light emitting display device of FIG. 7.

FIG. 12 is a block diagram illustrating an electronic device having an organic light emitting display device of FIG. 7.

Referring to FIG. 12, the electronic device 1000 may include a processor 1010, a memory device 1020, a storage device 1030, an input/output (I/O) device 1040, a power supply 1050, and an organic light emitting display device 1060. Here, the organic light emitting display device 1060 may correspond to the organic light emitting display device 100 of FIG. 7. In addition, the electronic device 1000 may further include a plurality of ports for communicating with a video card, a sound card, a memory card, a universal serial bus (USB) device, other electronic devices, etc.

The processor 1010 may perform various computing functions. The processor 1010 may be a micro processor, a central processing unit (CPU), etc. The processor 1010 may be coupled to other components via an address bus, a control bus, a data bus, etc. Furthermore, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (Po- RAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 1030 may also store data for operations of the electronic device 1000. The storage device 1030 may be a solid state drive (SSD) device, a hard disk drive (HDD) device, a CD-ROM device, etc.

The I/O device 1040 may be an input device such as a keyboard, a keypad, a touchpad, a touch-screen, a mouse, etc, and an output device such as a printer, a speaker, etc. According to some exemplary embodiments, the organic light emitting display device 1060 may be included in the I/O device 1040. The power supply 1050 may provide power for operation of the electronic device 1000. The organic light emitting display device 1060 may communicate with other components via the buses or other communication links. As described above, the organic light emitting display device 1060 may employ a simultaneous emission driving method. Specifically, the organic light emitting display device 1060 may include a display panel having a plurality of pixel circuits, a scan driving unit that provides a scan signal to the pixel circuits, a data driving unit that provides a data signal to the pixel circuits, a power unit that provides a high power voltage and a low power voltage to the pixel circuits, a control signal generating unit that provides an emission control signal to the pixel circuits, where the emission control signal controls the pixel circuits to simultaneously emit light, and a timing control unit that controls the scan driving unit, the data driving unit, the power unit, and the control signal generating unit. Here, the scan driving unit may control an average emission waiting time of pixel circuits coupled to odd scan-lines and an average emission waiting time of pixel circuits coupled to even scan-lines so as to be close to an average emission waiting time of pixel circuits coupled to all scan-lines by changing a direction of a scanning operation during one image frame, or by changing a direction of a scanning operation during adjacent image frames. Therefore, the luminance uniformity of the display panel included in the organic light emitting display device 1060 may be improved. As a result, the organic light emitting display device 1060 may display (i.e., may output) a high-quality image.

The present invention may be applied to an electronic device having an organic light emitting display device. For example, the present invention may be applied to a television, a computer monitor, a laptop, a digital camera, a cellular phone, a smart phone, a smart pad, a television, a personal digital assistant (PDA), a portable multimedia player (PMP), a MP3 player, a camcorder, a navigation system, a game console, a video phone, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A method of driving an organic light emitting display device comprising first and second pixel circuits to emit light, comprising:

sequentially writing a first data signal for an image frame into the first pixel circuits coupled to first scan-lines by sequentially performing a scanning operation on the first scan-lines in a first direction;

sequentially writing a second data signal for the image frame into the second pixel circuits coupled to second scan-lines by sequentially performing the scanning operation on the second scan-lines in a second direction; and simultaneously performing a light emission operation of all of the first and second pixel circuits for the image frame after the sequentially writing the first data signal and the second data signal, all of the first and second pixel circuits being capable of emitting light during the light emission operation.

2. The method of claim 1, wherein the first scan-lines correspond to odd scan-lines, and the second scan-lines correspond to even scan-lines.

3. The method of claim 1, wherein the first scan-lines correspond to even scan-lines, and the second scan-lines correspond to odd scan-lines.

4. The method of claim 1, wherein the first direction corresponds to a direction from a top scan-line to a bottom scan-line, and the second direction corresponds to a direction from the bottom scan-line to the top scan-line.

5. The method of claim 1, wherein the first direction corresponds to a direction from a bottom scan-line to a top scan-line, and the second direction corresponds to a direction from the top scan-line to the bottom scan-line.

6. A method of driving an organic light emitting display device comprising first and second pixel circuits to emit light, comprising:

sequentially writing a first data signal for a (2k−1)th image frame, where k is an integer not less than 1, into the first pixel circuits coupled to first scan-lines by sequentially performing a scanning operation on the first scan-lines in a first direction;

sequentially writing a second data signal for the (2k−1)th image frame into the second pixel circuits coupled to second scan-lines by sequentially performing the scanning operation on the second scan-lines in a second direction;

simultaneously performing a light emission operation of all of the first and second pixel circuits for the (2k−1)th image frame after the sequentially writing the first data signal and the second data signal, all of the first and second pixel circuits being capable of emitting light during the light emission operation;

sequentially writing a third data signal for a (2k)th image frame into the first pixel circuits coupled to the first scan-lines by sequentially performing the scanning operation on the first scan-lines in the second direction;

sequentially writing a fourth data signal for the (2k)th image frame into the second pixel circuits coupled to the second scan-lines by sequentially performing the scanning operation on the second scan-lines in the first direction; and simultaneously performing the light emission operation of all of the first and second pixel circuits for the (2k)th image frame after the sequentially writing the third data signal and the fourth data signal, all of the first and second pixel circuits being capable of emitting light during the light emission operation.

7. The method of claim 6, wherein the first scan-lines correspond to odd scan-lines, and the second scan-lines correspond to even scan-lines.

8. The method of claim 6, wherein the first scan-lines correspond to even scan-lines, and the second scan-lines correspond to odd scan-lines.

9. The method of claim 6, wherein the first direction corresponds to a direction from a top scan-line to a bottom scan-line, and the second direction corresponds to a direction from the bottom scan-line to the top scan-line.

10. The method of claim 6, wherein the first direction corresponds to a direction from a bottom scan-line to a top scan-line, and the second direction corresponds to a direction from the top scan-line to the bottom scan-line.

11. An organic light emitting display device, comprising:

a display panel having a plurality of pixel circuits to emit light;

a scan driving unit to provide a scan signal to the pixel circuits;

a data driving unit to provide a data signal to the pixel circuits;

a power unit to provide a high power voltage and a low power voltage to the pixel circuits;

a control signal generating unit to provide an emission control signal to the pixel circuits, the emission control signal controlling the pixel circuits to simultaneously emit light; and a timing control unit to control the scan driving unit, the data driving unit, the power unit, and the control signal generating unit, the scan driving unit controlling an average emission waiting time of the pixel circuits coupled to odd scan-lines and an average emission waiting time of the pixel circuits coupled to even scan-lines, the scan driving unit performing one operation or another operation, said one operation of the scan driving unit comprising:

sequentially writing a first data signal for an image frame into the pixel circuits coupled to odd scan-lines by sequentially performing a scanning operation on the odd scan-lines in a first direction;

sequentially writing a second data signal for the image frame into the pixel circuits coupled to even scan-lines by sequentially performing the scanning operation on the even scan-lines in a second direction; and simultaneously performing a light emission operation of all of the pixel circuits for the image frame after the sequentially writing the first data signal and the second data signal, all of the pixel circuits being capable of emitting light during the light emission operation, said another operation of the scan driving unit comprising sequentially writing the first data signal for a (2k−1)th image frame, where k is an integer not less than 1, into the pixel circuits coupled to the odd scan-lines by sequentially performing scanning operation on the odd scan-lines in a first direction;

sequentially writing a second data signal for the (2k−1)th image frame into the pixel circuits coupled to even scan-lines by sequentially performing the scanning operation on the even scan-lines in a second direction;

simultaneously performing the light emission operation of all of the pixel circuits for the (2k−1)th image frame after the sequentially writing the first data signal and the second data signal, all of the pixel circuits being capable of emitting light during the light emission operation;

sequentially writing a third data signal for a (2k)th image frame into the pixel circuits coupled to the odd scan-lines by sequentially performing the scanning operation on the odd scan-lines in the second direction;

sequentially writing a fourth data signal for the (2k)th image frame into the pixel circuits coupled to the even scan-lines by sequentially performing the scanning operation on the even scan-lines in the first direction; and simultaneously performing the light emission operation of all of the pixel circuits for the (2k)th image frame after the sequentially writing the third data signal and the fourth data signal, all of the pixel circuits being capable of emitting light during the light emission operation.

12. The device of claim 11, wherein the first direction corresponds to a direction from a top scan-line to a bottom scan-line, and the second direction corresponds to a direction from the bottom scan-line to the top scan-line.

13. The device of claim 11, wherein the first direction corresponds to a direction from a bottom scan-line to a top scan-line, and the second direction corresponds to a direction from the top scan-line to the bottom scan-line.

* * * * *